US007915213B2

(12) United States Patent
Adamy et al.

(10) Patent No.: US 7,915,213 B2
(45) Date of Patent: Mar. 29, 2011

(54) HIGH ASH LIQUID LAUNDRY DETERGENTS COMPRISING A UREA AND/OR GLYCERINE HYGROSCOPIC AGENT

(75) Inventors: Steven T. Adamy, Lawrenceville, NJ (US); Jennifer Forman, Mt. Laurel, NJ (US)

(73) Assignee: Church & Dwight Co., Inc., Princeton, NJ (US)

( * ) Notice: Subject to any disclaimer, the term of this patent is extended or adjusted under 35 U.S.C. 154(b) by 0 days.

(21) Appl. No.: 12/109,629

(22) Filed: Apr. 25, 2008

(65) Prior Publication Data

US 2008/0274936 A1 Nov. 6, 2008

Related U.S. Application Data

(60) Provisional application No. 60/914,599, filed on Apr. 27, 2007.

(51) Int. Cl.
*C11D 3/10* (2006.01)
*C11D 1/94* (2006.01)

(52) U.S. Cl. ..... 510/351; 510/276; 510/290; 510/405; 510/422; 510/427; 510/432; 510/490; 510/478; 510/509; 510/501

(58) Field of Classification Search ..... 510/276, 510/290, 351, 405, 422, 427, 432, 490, 509, 510/478, 501
See application file for complete search history.

(56) References Cited

U.S. PATENT DOCUMENTS

| | | | | | |
|---|---|---|---|---|---|
| 4,375,421 | A | * | 3/1983 | Rubin et al. | 510/403 |
| 4,462,922 | A | * | 7/1984 | Boskamp | 510/393 |
| 5,489,397 | A | * | 2/1996 | Bainbridge | 510/337 |
| 5,573,701 | A | * | 11/1996 | Bulfari et al. | 510/397 |
| H1776 | H | * | 1/1999 | Linard et al. | 510/530 |
| 5,858,951 | A | | 1/1999 | Ip et al. | |
| 5,863,878 | A | | 1/1999 | Carr et al. | |
| 5,977,047 | A | | 11/1999 | Carr | |
| 6,699,828 | B1 | * | 3/2004 | de Buzzaccarini et al. | 510/372 |
| 7,041,628 | B2 | * | 5/2006 | Sunder et al. | 510/223 |
| 2002/0183226 | A1 | * | 12/2002 | Kasturi et al. | 510/320 |
| 2004/0167048 | A1 | * | 8/2004 | Sunder et al. | 510/220 |
| 2004/0204336 | A1 | * | 10/2004 | Himmrich et al. | 510/504 |
| 2007/0066504 | A1 | * | 3/2007 | Hsu et al. | 510/276 |
| 2007/0187429 | A1 | * | 8/2007 | Farahmand | 222/94 |
| 2007/0287654 | A1 | * | 12/2007 | Hsu et al. | 510/488 |
| 2008/0058393 | A1 | * | 3/2008 | Kobara Pestell et al. | 514/365 |

* cited by examiner

*Primary Examiner* — Charles I Boyer
(74) *Attorney, Agent, or Firm* — Stuart D. Frenkel; Stephen B. Shear

(57) ABSTRACT

An aqueous based liquid laundry detergent comprises at least 15 wt. % of an alkali metal carbonate builder and a hygroscopic agent in sufficient amounts to maintain the stability of the detergent composition and reduce the formation of insoluble hydrates of the carbonate builder.

10 Claims, No Drawings

HIGH ASH LIQUID LAUNDRY DETERGENTS COMPRISING A UREA AND/OR GLYCERINE HYGROSCOPIC AGENT

CROSS-REFERENCE TO RELATED APPLICATION

This application claims priority to Provisional Application 60/914,599, filed Apr. 27, 2007.

BACKGROUND OF THE INVENTION

Field of the Invention

This invention relates to laundry detergent compositions having a high water soluble alkaline carbonate (soda ash) builder content.

Laundry detergent compositions comprising a water-soluble alkaline carbonate are well-known in the art. For example, it is conventional to use such a carbonate as a builder in detergent compositions which supplement and enhance the cleaning effect of an active surfactant present in the composition. Such builders improve the cleaning power of the detergent composition, for instance, by the sequestration or precipitation of hardness causing metal ions such as calcium, peptization of soil agglomerates, reduction of the critical micelle concentration, and neutralization of acid soil, as well as by enhancing various properties of the active detergent, such as its stabilization of solid soil suspensions, solubilization of water-insoluble materials, emulsification of soil particles, and foaming and sudsing characteristics. Other mechanisms by which builders improve the cleaning power of detergent compositions are probably present but are less well understood. Builders are important not only for their effect in improving the cleaning ability of active surfactants in detergent compositions, but also because they allow for a reduction in the amount of the surfactant used in the composition, the surfactant being generally much more costly than the builder.

Sodium carbonate ($Na_2CO_3$) and/or potassium carbonate ($K_2CO_3$) are the most common carbonates included in laundry detergents to impart increased alkalinity to wash loads, thereby improving detergency against many types of soils. In particular, soils having acidic components e.g. sebum and other fatty acid soils, respond especially well to increased alkalinity.

While laundry detergents containing a relatively large amount of carbonate builder are generally quite satisfactory in their cleaning ability, the use of such carbonate builders often results in the problem of calcium carbonate precipitation, which may give rise to fabric encrustation due to the deposition of the calcium carbonate on the fiber surfaces of fabrics which in turn causes fabric to have a stiff hand and gives colored fabrics a faded appearance. Thus, any change in available carbonate built laundry detergent compositions which reduces their tendency to cause fabric encrustation is highly desirable.

In many applications, it is desirable to include $Na_2CO_3$ and $K_2CO_3$ in detergent formulations at levels greater than 20%. This is readily achieved in the case of a powdered detergent. However, incorporating such large amounts into an aqueous liquid is much more difficult. In liquid laundry detergent compositions, the incorporation of a large amount of detergent builder poses a significant formulation challenge since the presence of a major quantity of detergent builder inevitably causes the detergent composition to phase separate. Liquid detergent formulations that contain a detergent builder ingredient require careful control of the surfactant to builder ratio so as to prevent salting-out of the surfactant phase.

Liquid laundry detergent compositions are also susceptible to instability under extended freeze/thaw and high/low temperature conditions.

Additionally, sodium carbonate forms an extensive array of low water soluble hydrates at low temperatures and high, i.e., >15 wt. % levels of the sodium carbonate builder. For example, a system with 20% carbonate builder will form a decahydrate phase below 23° C. At 30% sodium carbonate, the decahydrate will form below 31° C. Therefore, even at room temperature, systems containing greater than 20% carbonate builder are inherently unstable and readily form decahydrate phases. Once the decahydrate forms, redissolution can take an inordinate amount of time.

Accordingly, there is still a desire and a need to provide a stable liquid laundry detergent which has a high ash content.

SUMMARY OF THE INVENTION

In accordance with the present invention, a stable aqueous-based liquid laundry detergent is provided with an ash content of greater than 15 wt. % by incorporating a hygroscopic agent therein in sufficient amounts to prevent excessive insoluble hydrate formation. One or more surfactants including anionic, non-ionic and amphoteric or zwitterionic surfactants can be added. Stability of the liquid composition is further provided by adjusting the ratio of anionic surfactant to zwitterionic surfactant contained in the composition.

DETAILED DESCRIPTION OF THE INVENTION

The water-soluble alkaline carbonate builder in the detergent composition of this invention may be, for example, an alkali metal carbonate, bicarbonate or sesquicarbonate, preferably sodium or potassium carbonate, bicarbonate or sesquicarbonate, and most preferably sodium carbonate or mixtures of sodium carbonate and potassium carbonate. A combination of more than one of such compounds may be used, e.g., sodium carbonate and sodium bicarbonate. The total alkaline carbonate may be present in an amount, for example, of greater than 15 wt. %, up to about 40 wt. %. Preferably about 20 to about 30 wt. % of sodium carbonate or mixtures of sodium carbonate and potassium carbonate are used.

To reduce the formation of water insoluble hydrates of the carbonate builder, the composition of the present invention includes one or more hygroscopic agents. Useful hygroscopic agents include polyols such as glycerin as well as urea. Other compounds known to bind water are useful hygroscopic agents for incorporation into the composition. In general, 5-25 percent by weight of the composition will comprise the hygroscopic agent.

The active surfactant component of the detergent composition of this invention may be, for example, one or more of many suitable synthetic detergent active compounds which are commercially available and described in the literature, e.g., in "Surface Active Agents and Detergents," Volumes 1 and 2 by Schwartz, Perry and Berch. Several detergents and active surfactants are also described in, for example, U.S. Pat. Nos. 3,957,695; 3,865,754; 3,932,316 and 4,009,114. In general, the composition may include a synthetic anionic, non-ionic, amphoteric or zwitterionic detergent active compound, or mixtures of two or more of such compounds.

More preferably, the laundry detergent compositions of this invention contain at least one anionic, and, most preferably, a mixture of at least one anionic and an amphoteric or zwitterionic surfactant.

The contemplated water soluble anionic detergent surfactants are the alkali metal (such as sodium and potassium) salts of the higher linear alkyl benzene sulfonates and the alkali metal salts of sulfated ethoxylated and unethoxylated fatty alcohols, and ethoxylated alkyl phenols. The particular salt will be suitably selected depending upon the particular formulation and the proportions therein.

The sodium alkybenzenesulfonate surfactant (LAS), if used in the composition of the present invention, preferably has a straight chain alkyl radical of average length of about 11 to 13 carbon atoms.

Specific sulfated surfactants which can be used in the compositions of the present invention include sulfated ethoxylated and unethoxylated fatty alcohols, preferably linear primary or secondary monohydric alcohols with $C_{10}$-$C_{18}$, preferably $C_{12}$-$C_{16}$, and more preferably, $C_{11}$-$C_{15}$, alkyl groups and, if ethoxylated, on average about 1-15, preferably 2-12, and most preferably 2-7 moles of ethylene oxide (EO) per mole of alcohol, and sulfated ethoxylated alkylphenols with $C_8$-$C_{16}$ alkyl groups, preferably $C_8$-$C_9$ groups, and on average from 4-12 moles of EO per mole of alkyl phenol.

The preferred class of anionic surfactants are the sulfated ethoxylated linear alcohols, such as the $C_{12}$-$C_{16}$ alcohols ethoxylated with an average of from about 1 to about 12 moles of ethylene oxide per mole of alcohol.

Specific non-ionic surfactants which can be used in the composition of the present invention include ethoxylated fatty alcohols, preferably linear primary or secondary monohydric alcohols with $C_{10}$-$C_{18}$ and preferably $C_{12}$-$C_{16}$, alkyl groups and on average about 1-15, preferably 1-12 moles of ethylene oxide (EO) per mole of alcohol, and ethoxylated alkylphenols with $C_8$-$C_{16}$ alkyl groups, preferably $C_8$-$C_9$ alkyl groups, and on average about 4-12 moles of EO per mole of alkyl phenol.

The preferred class of nonionic surfactants are the ethoxylated linear alcohols, such as the $C_{12}$-$C_{16}$ alcohols ethoxylated with an average of from about 1 to about 12 moles of ethylene oxide per mole of alcohol.

Mixtures of the foregoing synthetic detergent types of surfactants, e.g., of anionic and nonionic, or of different specific anionic or nonionic surfactants, may be used to modify the detergency, sudsing characteristics, and other properties of the composition. For example, a mixture of different fatty alcohols of 12 to 16 carbon atoms may be ethoxylated, directly sulfated, or sulfated after ethoxylation, a fatty alcohol may be partially ethoxylated and sulfated, or an ethoxylated fatty acid may be partially sulfated to yield a mixture of different anionic and nonionic surfactants or different specific anionic or nonionic surfactants.

Further surfactants which can be used in the laundry detergent formulations according to the invention are amphoteric or zwitterionic surfactants, e.g. alkylbetaines, alkylamidobetaines, alkyliminopropionates, aminoglycinates or amphoteric imidazolineum carboxylates, sulfobetaines, sultaines and amine oxide compounds.

Preferred amphoteric surfactants of this formula are monocarboxylates and dicarboxylates. Examples thereof are cocoamphocarboxypropionate, cocoamidocarboxypropionic acid, cocoamphocarboxyglycinate (also referred to as cocoamphodiacetate) and cocoamphoacetate.

Further preferred amphoteric surfactants are alkyldimethylbetaines and alkyldipolyethoxybetaines with an alkyl radical having about 8 to about 22 carbon atoms, which may be linear or branched, preferably having 8 to 18 carbon atoms and particularly preferably having about 12 to about 18 carbon atoms. These compounds are marketed, for example, by Clariant GmbH under the trade name Genagen LAB.

The total active surfactant in the composition may be in the range, for example, of about 3 to 10 wt. %, preferably about 4 to 6 wt. % based on the weight of the composition. If, as preferred, the active surfactant contains of a combination of anionic and amphoteric surfactants, then the weight ratio of anionic surfactant to amphoteric surfactant should be in the range of about 1/30 to 8/1. A more preferred range would be from about 2/3 to about 3/1.

Other agents useful to stabilize the composition and prevent phase separation include thickening agents, gelling agents and dispersing agents. Examples include silica, polyacrylates such as Carbopols, alkyloxylated polycarboxylates, alkoyxylated diamines, e.g. Tetronics from BASF, and alkylpolyglucosides, etc. In general, the stabilizing agents will comprise from about 0.5 to 10 wt. % of the composition.

The balance of the detergent composition will comprise water, generally from about 15 to 75 wt. % of the composition. More preferably, the composition will contain at least 45 wt. % up to 75 wt. % water.

Example 1

The following samples shown in Table 1 were made.

TABLE 1

| Sample | Wt. % NaLAS | Wt. % $C_{12-16}(EO)_7$ | Wt. % CAP-betaine | Wt. % Carbopol 676 | Wt. % Ash | Wt. % ES8018-O[1] | Wt. % Glycerin | Wt. % Water |
|---|---|---|---|---|---|---|---|---|
| 1 | 1.56 | 0.44 | 1.5 | 0.4 | 30 | 0 | 0 | q.s. |
| 2 | | | | | | | 5 | |
| 3 | | | | | | | 10 | |
| 4 | | | | | | | 15 | |
| 5 | | | | | | 1.5 | 0 | |
| 6 | | | | | | | 5 | |
| 7 | | | | | | | 10 | |
| 8 | | | | | | | 15 | |
| 9 | | | | | | 3.0 | 0 | |
| 10 | | | | | | | 5 | |
| 11 | | | | | | | 10 | |
| 12 | | | | | | | 15 | |

[1]ethoxylated polycarboxylate- BASF

The samples were prepared and allowed to sit for 24 to 48 hours. Following formulation, a portion of each was additionally frozen and thawed later at 25° C. to observe freeze-thaw recoverability. The results are summarized in Table 2.

TABLE 2

| Sample | Appearance before hand stir | Appearance after stir | Appearance following 1X Freeze-thaw |
|---|---|---|---|
| 1 | Granular soil | | |
| 2 | Hard solid | | |
| 3 | Flowable, homogeneous | Flowable, homogeneous | No flow, but deformable |

TABLE 2-continued

| Sample | Appearance before hand stir | Appearance after stir | Appearance following 1X Freeze-thaw |
|---|---|---|---|
| 4 | Slow flow, homogeneous | Slow flow, homogeneous | No flow, but deformable |
| 5 | Soft granular solid | | |
| 6 | Hard granular solid | | |
| 7 | Flowable, homogeneous | Flowable, homogeneous | Very slow flow |
| 8 | Slow flow, homogeneous | Slow flow, homogeneous | No flow, but deformable |
| 9 | Soft granular solid | | |
| 10 | Soft granular solid | | |
| 11 | Flowable, homogeneous | Flowable, homogeneous | Very slow flow |
| 12 | No flow, deformable | No flow, deformable | No flow, deformable |

Initially it was found that between 5 and 10 wt. % glycerin was required to produce liquid samples. It was further observed that compositions 7 and 11 recovered from the freeze-thaw cycle with some degree of flowability, however, the rate of flow was very slow. It was thought that the level of Carbopol (at 0.4%) may have been too high. Therefore, a series of samples based on samples 3, 4, 7, 8, 11, and 12 above, only with 0.2% Carbopol 676 instead, were prepared. Observations of these samples are recorded below in Table 3

TABLE 3

| Sample | Appearance before hand stir | Appearance after stir | Appearance following Freeze-thaw |
|---|---|---|---|
| 3A | Liquid + settled solid | Liquid + settled solid | Flowable |
| 4A | Liquid + settled solid | Liquid + settled solid | Flowable |
| 7A | Some settled material, liquid phase has more dispersed material than 3, 4 | Homogenous, temporarily stable | Not flowable |

TABLE 3-continued

| Sample | Appearance before hand stir | Appearance after stir | Appearance following Freeze-thaw |
|---|---|---|---|
| 8A | Soft, non-flowable granular paste | Soft, non-flowable granular paste | No flow |
| 11A | Flowable, homogeneous | Flowable, homogeneous | Flowable |
| 12A | Soft granular paste | Soft granular solid | No flow |

The decrease in Carbopol level therefore improved the freeze-thaw recoverability of sample 11, but may have decreased the degree of structure for 3, 4, and 7.

Example 2

Systems were also formulated containing urea. Compositions are shown in Table 4.

TABLE 4

| Component | Urea formula 1 (Wt. %) | Urea formula 2 (Wt. %) |
|---|---|---|
| NaLAS | 1.56 | 1.56 |
| $C_{12^-16}(EO)_7$ | 0.44 | 0.44 |
| Cocamidopropyl betaine | 1.5 | 1.5 |
| Carbopol 676 | 0.2 | 0.2 |
| Soda ash | 30 | 30 |
| Urea | 10 | 5 |
| Glycerin | | 5 |
| Water | q.s. | q.s. |

Both systems were pourable 24 hours later and recovered from 1 freeze-thaw cycle.

Example 3

Additional samples as shown in Table 5 were formulated.

TABLE 5

| Sample | Wt. % NaLAS | Wt % P103[2] | Wt. % $C_{12-16}(EO)_7$ | Wt % CAP-betaine | Wt. % Carbopol 676 | Wt. % Ash | Wt. % ES8018-O | Wt. % Glycerin | Wt. % Water |
|---|---|---|---|---|---|---|---|---|---|
| 5-1 | 1.28 | 0.56 | 0.64 | 1.89 | 0.05 | 30 | 3.0 | 10 | q.s. |
| 5-2 | | | | | 0.07 | | | | |
| 5-3 | | | | | 0.1 | | | | |

[2]Pluronic EO-PO surfactant- BASF

All formulas were shear-deformable gel-like slurries.

Example 4

Compositions prepared substituting Pluronic L101 for P103 are shown in Table 6.

TABLE 6

| Sample | Wt. % NaLAS | Wt % L101 | Wt. % $C_{12-16}(EO)_7$ | Wt. % CAP-betaine | Wt. % Carbopol 676 | Wt. % Ash | Wt. % ES8018-O | Wt. % Glycerin | Wt. % Water |
|---|---|---|---|---|---|---|---|---|---|
| 6-1 | 1.66 | 0.58 | 0.83 | 1.30 | 0.05 | 30 | 3.0 | 10 | q.s. |
| 6-2 | | | | | 0.07 | | | | |
| 6-3 | | | | | 0.1 | | | | |

All formulas were shear-deformable gel-like slurries.

Example 5

Compositions containing a mixture of alkali metal carbonates were prepared as shown in Table 7.

TABLE 7

| Material | Sample 7-1 (wt. %) | Sample 7-2 (wt. %) |
|---|---|---|
| Biosoft D62LT (Stepan)(55% active Na-dodecylbenzesulfonate) | 3.01 | 3.01 |
| Pluronic L101 (BASF)(EO-PO-EO block copolymer) | 1.05 | 1.05 |
| Tetronic 901 (BASF)(Ethylene diamine derivatized with EO-PO-EO block copolymers) | 0.25 | 0.25 |
| Alfonic 1216CO7 (Sasol)($C_{12}$-$C_{16}$ $(EO)_7$ ethoxylated alcohol) | 0.83 | 0.83 |
| Tego ZF (Degussa)(30% active cocamidopropyl betaine) | 4.34 | 4.34 |
| Carbopol 676 (Noveon)(polyacrylic acid copolymer) | 0.2 | 0.4 |
| Sokalon ES8018-0 (BASF)(45% acive ethoxylated polyacrylic acid) | 6.66 | 6.66 |
| $Na_2CO_3$ | 22.5 | 22.5 |
| $K_2CO_3$ | 7.5 | 7.5 |
| $CaCO_3$(approx. 15 μm particle size) | | 1.5 |
| Glycerin | 10 | 10 |
| Deionized water | q.s. | q.s. |

Comments on Processing

It has been found that at least two processing factors are useful to the stability of the system. A series of samples similar to composition 7-1 (only that $Na_2CO_3$ was added first) were prepared at different temperatures. Appearances of each are noted in Table 8.

TABLE 8

| Processing temperature (° C.) | Sample appearance at 25° C. |
|---|---|
| 25 | Creaming and settled solid |
| 40 | Creaming and settled solid |
| 50 | Loose flocculent, slight settling of solid |
| 55 | Uniform, creamy emulsion, little to no |
| 60 | settling over 3 days. After 6 days, more |
| 65 | creaming evident. |

A second useful processing factor was found to be the relative orders of $K_2CO_3$ and $Na_2CO_3$. It was found that samples based on Example 7-1, where $K_2CO_3$ was added first, did not exhibit creaming like similar samples made with the addition of $Na_2CO_3$ first. Thus, adding $K_2CO_3$ first promoted increased stability in these systems.

Example 6

The following compositions encompassed varying ratios of Alkyl poly glucoside (APG) and Pluronic L101. Values are in weight % and presented on an as is basis in Table 9.

TABLE 9

| Material | 9-1 | 9-2 | 9-3 | 9-4 |
|---|---|---|---|---|
| Steol CS130 (Stepan) (26% active Na-laureth-1-sulfate) | 7.38 | 7.38 | 7.38 | 7.38 |
| Pluronic L101 (BASF) (EO-PO-EO block copolymer MW = 3800, HLB = 1) | 0.90 | 0.80 | 0.70 | 0.60 |
| Glucopon 625 (Cognis) (50.7% active lauryl polyglucoside) | 0.30 | 0.49 | 0.69 | 0.89 |

TABLE 9-continued

| Material | 9-1 | 9-2 | 9-3 | 9-4 |
|---|---|---|---|---|
| Tetronic 901 (BASF) (Ethylene diamine derivatized with EO-PO-EO block copolymers) | 0.25 | 0.25 | 0.25 | 0.25 |
| Alfonic 1216CO7 (Sasol) ($C_{12}$-$C_{16}$ 7EO ethoxylated alcohol) | 0.64 | 0.64 | 0.64 | 0.64 |
| Alfonic 1216CO3 (Sasol) ($C_{12}$-$C_{16}$ 3EO ethoxylated alcohol) | 0.32 | 0.32 | 0.32 | 0.32 |
| Mirataine BET O-30 (Rhodia) (30% active oleoamidopropyl dimethyl betaine) | 2.09 | 2.09 | 2.09 | 2.09 |
| Carbopol 676 (Noveon) (polyacrylic acid copolymer) | 0.20 | 0.20 | 0.20 | 0.20 |
| Sokalan ES95044 (BASF) (50% active ethoxylated polyacrylic acid) | 6.00 | 6.00 | 6.00 | 6.00 |
| $Na_2CO_3$ (Finely Ground) | 25.00 | 25.00 | 25.00 | 25.00 |
| $K_2CO_3$ | 5.00 | 5.00 | 5.00 | 5.00 |
| Glycerin | 10.00 | 10.00 | 10.00 | 10.00 |
| Deionized water | q.s. | q.s. | q.s. | q.s. |

Procedure:

Samples were prepared at quantities of 300 g in a 600 mL beaker. Mixing was done with an overhead mixer, using a 1.5" radial flow impeller (for example, Lightnin R-100).

1. Water was added to the beaker and stirred at 350 rpm. The water was then heated to 60° C.
2. During the heating, before the temperature reached 40° C., a mass of $K_2CO_3$ equal to 1% of the total formula mass being made was added (e.g. 3.0 g of $K_2CO_3$ was added, since the total mass of the sample was 300 g).
3. At 40° C., the Carbopol 676 was added. The mixture was further stirred at 350 rpm while it was heated to 60° C. Stirring continued for about 35 minutes until the Carbopol was dissolved.
4. Glycerin was then added and dissolved.
5. ES95044 was added and dissolved.
6. The balance of the $K_2CO_3$ was added and dissolved.
7. The $Na_2CO_3$ was added. The mixtures were stirred during the $Na_2CO_3$ addition at 500 rpm. The rate was reduced to 400 rpm when all of the $Na_2CO_3$ was added. Stirring continued until uniform, with the mixtures appearing as white dispersed systems.
8. The stirring rate was maintained at 400 rpm.
9. The CS130 was then added. The mixtures were stirred until uniform.
10. The BET O-30 was then added. The mixtures were stirred until uniform.
11. The Alfonic 1216-7 was then added. The mixtures were stirred until uniform.
12. The Alfonic 1216-3 was then added. The mixtures were stirred until uniform
13. The Glucopon was then added. The mixtures were stirred until uniform.
14. The Pluronic L101 was then added. The mixtures were stirred until uniform.
15. The Tetronic 901 was then added. The mixtures were stirred until uniform.
16. The mixtures then continued to be stirred at 400 rpm and 60° C. for 20 minutes.
17. The mixtures were then removed from the heat, and the rate was reduced to 300 rpm.
18. The mixtures were allowed to cool to 25° C. over a period of 4 hours, while being stirred at 300 rpm.
19. The mixtures were then stirred overnight at 130 rpm.
20. The mixtures were removed from the mixers, and poured into polystyrene containers.

All formulas were uniform, flowable dispersions.

Detergency Testing

Example 9-3, containing 4.8% total surfactant (actives basis), 25% $Na_2CO_3$, and 5% $K_2CO_3$, was evaluated for detergency against a commercial laundry detergent formula containing 6.9% total surfactant and 3.3% $Na_2CO_3$. Evaluations were performed in a Terg-o-Tometer (Instrument Marketing Services, Inc., Fairfield, N.J.). The device consists of six 1 L buckets with accompanying agitators in order to simulate a washing cycle.

Six soils were chosen for evaluation:

| Soil | Fabric |
|---|---|
| Dust-sebum | Cotton 400 |
| EMPA 101 (Olive oil-carbon black) | Cotton 400 |
| Clay | Cotton 400 |
| Dust-sebum | Polyester-cotton 7435WRL |
| EMPA 101 (Olive oil-carbon black) | Polyester-cotton 7435WRL |
| Clay | Polyester-cotton 7435WRL |

Swatches of each were cut to 2 and ¼ inches square peak to valley with a pinked (zig-zag) cut.

Detergents were added to the Terg buckets at a level of 1.3 g. An appropriate level of water was then added in order to make a total of 990 mL. The water had previously been pre-heated to about 88° F. (the target wash temperature). The solutions in the buckets were then allowed to equilibrate with the terg bath to a temperature of 88±1° F. The terg timer was then set at 11 minutes. The terg was started, and 10 mL of 10,000 ppm (calculated as equivalent level of $CaCO_3$) hard water was added to each bucket. The hardness of each bucket was therefore 100 ppm. With approximately 10 minutes remaining in the wash cycle, 2 swatches of each soil were added to each terg bucket (for a total of 14 swatches per bucket).

At the conclusion of the wash cycle, the swatches were removed from each bucket, squeezed by hand, and placed on a screen. The buckets were then rinsed. To each bucket was then added 990 ml of fresh deionized water along with 10 mL of 10,000 ppm water. Solutions in each bucket were mixed as before. The temperature in each bucket was then allowed to equilibrate at 88±1° F. The terg timer was set to 5 minutes, started, and swatches were added to each bucket. Following this rinse process, the swatches were removed, squeezed by hand, and placed on sieves.

To dry the swatches, a cap was placed on top of the sieve holding the swatches. A heat gun was then used to blow hot air up beneath and through the sieve. Drying of the swatches typically took a couple of minutes.

Runs were performed in duplicate with samples assignments randomized between the buckets for each run.

Evaluation of Soil Removal

Soil removal was evaluated by comparing color assessments on swatches before washing and after washing. Color assessments in the CIE L*a*b* color space were performed on unwashed and washed swatches via a BYK Gardner Color-view spectrophotometer.

Summaries of % SR for each detergent are shown in Table 10. Values represent the average of four values. Standard deviations (SD) are also shown. Each of the values were assessed for significance versus the control using a double-sided t-test, with the assumption that the variability between the assessments was unknown, but about equal. Significance was assessed at a level of $\alpha$=0.05. In Table 10 below, values of % SR from the 9-3 formula not determined to be significantly different from the control are noted as "parity," while % SR values significantly greater than those of the control are noted as "significantly greater."

TABLE 10

| | | Control | | 9-3 | | Signifi- |
|---|---|---|---|---|---|---|
| Soil | Fabric | % SR | SD | % SR | SD | cance |
| Dust-sebum | Cotton 400 | 18.45 | 1.286 | 18.73 | 1.610 | Parity |
| EMPA 101 (Olive oil-carbon black) | Cotton 400 | 29.29 | 2.969 | 32.20 | 3.761 | Parity |
| Clay | Cotton 400 | 37.18 | 3.178 | 36.95 | 3.137 | Parity |
| Dust-sebum | Polyester-cotton 7435WRL | 32.17 | 0.9331 | 52.50 | 1.117 | Significantly Greater |
| EMPA 104 (Olive oil-carbon black) | Polyester-cotton 7435WRL | 28.10 | 2.330 | 28.76 | 1.830 | Parity |
| Clay | Polyester-cotton 7435WRL | 71.36 | 1.537 | 73.26 | 2.506 | Parity |

The experimental formula, with a lower total surfactant level than that of the control, performed at a level equal to or significantly greater than that of the control.

Example 7

The following compositions in Table 11 were made with Pluronic L121 (MW=4400, HLB=1). The compositions differ in the levels of $Na_2CO_3$ and $K_2CO_3$. All values are in weight % on an as is basis:

TABLE 11

| Material | 11-1 | 11-2 |
|---|---|---|
| Steol CS130 (Stepan) (26% active Na-laureth-1-sulfate) | 6.16 | 6.16 |
| Pluronic L121 (BASF) (EO-PO-EO block copolymer MW = 4400, HLB = 1) | 0.70 | 0.70 |
| Glucopon 625 (Cognis) (50.7% active lauryl polyglucoside) | 0.69 | 0.69 |
| Tetronic 901 (BASF) (Ethylene diamine derivatized with EO-PO-EO block copolymers) | 0.25 | 0.25 |
| Alfonic 1216CO7 (Sasol) ($C_{12}$-$C_{16}$ 7EO ethoxylated alcohol) | 0.60 | 0.60 |
| Alfonic 1216CO3 (Sasol) ($C_{12}$-$C_{16}$ 3EO ethoxylated alcohol) | 0.20 | 0.20 |
| Mirataine BET O-30 (Rhodia) (30% active oleoamidopropyl dimethyl betaine) | 4.17 | 4.17 |
| Carbopol 676 (Noveon) (polyacrylic acid copolymer) | 0.20 | 0.20 |
| Sokalan ES95044 (BASF) (50% active ethoxylated polyacrylic acid) | 6.00 | 6.00 |
| $Na_2CO_3$ (Finely Ground) | 25.00 | 22.5 |
| $K_2CO_3$ | 5.00 | 7.5 |
| Glycerin | 10.00 | 10.00 |
| Deionized water | q.s. | q.s. |

Both compositions were uniform, flowable dispersions.

Detergency Evaluation

The 11-1 and 11-2 formulas were assessed for detergency as described above. Results are shown in Tables 12 and 13.

TABLE 12

| Soil | Fabric | Control % SR | Control SD | 11-1 % SR | 11-1 SD | Significance |
|---|---|---|---|---|---|---|
| Dust-sebum | Cotton 400 | 16.13 | 0.8725 | 19.35 | 0.2971 | Significantly Greater |
| EMPA 101 (Olive oil-carbon black) | Cotton 400 | 25.23 | 1.761 | 29.43 | 2.126 | Significantly Greater |
| Clay | Cotton 400 | 31.06 | 1.486 | 32.91 | 1.654 | Parity |
| Dust-sebum | Polyester-cotton 7435WRL | 32.56 | 0.3984 | 52.31 | 1.213 | Significantly Greater |
| EMPA 104 (Olive oil-carbon black) | Polyester-cotton 7435WRL | 22.97 | 0.8235 | 22.34 | 0.6315 | Parity |
| Clay | Polyester-cotton 7435WRL | 71.49 | 3.482 | 71.49 | 2.802 | Parity |

TABLE 13

| Soil | Fabric | Control % SR | Control SD | 11-2 % SR | 11-2 SD | Significance |
|---|---|---|---|---|---|---|
| Dust-sebum | Cotton 400 | 16.13 | 0.8725 | 17.31 | 0.8879 | Parity |
| EMPA 101 (Olive oil-carbon black) | Cotton 400 | 25.23 | 1.761 | 29.74 | 0.6231 | Significantly Greater |
| Clay | Cotton 400 | 31.06 | 1.486 | 32.91 | 1.654 | Parity |
| Dust-sebum | Polyester-cotton 7435WRL | 32.56 | 0.3984 | 49.07 | 0.9982 | Significantly Greater |
| EMPA 104 (Olive oil-carbon black) | Polyester-cotton 7435WRL | 22.97 | 0.8235 | 22.78 | 1.513 | Parity |
| Clay | Polyester-cotton 7435WRL | 71.49 | 3.482 | 74.40 | 1.452 | Parity |

Both formulas (containing 4.96% total surfactant) performed at parity or significantly better than the control having 6.9% surfactant.

Example 8

The experimental formula 9-1 was tested at dose levels of 2.37 and 1.56 oz., and compared with a standard 3.125 oz. dose of a typical commercial laundry detergent. The effective surfactant levels at each dose are compared in Table 14.

TABLE 14

| Detergent | Dose in 71 L wash (oz.) | Dose in 71 L wash (g) | Mass of surfactant in dose (g) |
|---|---|---|---|
| Commercial HDL (control) | 3.125 | 96.9 | 6.69 |
| 9-1 | 2.37 | 100.0 | 4.80 |
| 9-1 | 1.56 | 65.9 | 3.16 |

Therefore, the levels of surfactant in the experimental detergent doses were less than that in the standard detergent.

The following swatches were evaluated:

| | | | | |
|---|---|---|---|---|
| Soil Swatches | Dust-Sebum | Cotton #400 | Scientific Services | |
| | Dust-Sebum | Style 7435WRL 65/35 Polyester/Cotton Shirting | Scientific Services | |
| | Ground - in - Clay | Cotton #400 | Scientific Services | |
| | Ground - in - Clay | Style 7435WRL 65/35 Polyester/Cotton Shirting | Scientific Services | |
| | Standard Soil | Cotton S/493 | Test Fabrics | |
| | Carbon Black/Olive Oil | Cotton | Test Fabrics | EMPA 101 |
| | Carbon Black/Olive Oil | Polyester/Cotton 67/33 | Test Fabrics | EMPA 104 |
| Stain Swatches | Grass | Cotton #400 | Scientific Services | |
| | Coffee | Cotton #400 | Scientific Services | |
| | Beef Gravy | Cotton #400 | Scientific Services | |
| | Ketchup | Cotton #400 | Scientific Services | |
| | Makeup | Cotton #400 | Test Fabrics | |
| | Blood/Milk/Carbon Black | Cotton | Test Fabrics | EMPA 116 |
| | Blood/Milk/Carbon Black | Polyester/Cotton 67/33 | Test Fabrics | EMPA 117 |
| | Cocoa | Cotton | Test Fabrics | EMPA 112 |
| | Red Wine | Cotton #400 | Scientific Services | |
| | Chocolate Ice Cream | Cotton #400 | Scientific Services | |
| | Mustard | Cotton #400 | Scientific Services | |
| | Blueberry | Cotton #400 | Scientific Services | |
| | Blood | Cotton #400 | Scientific Services | |

Four total replicates of each swatch were run by fastening one swatch of each type to a pillowcase (for a total of four pillowcases). Two pillowcases were washed in one washer while the remaining two pillowcases were washed in another washer of the same make and model. The water hardness was carefully controlled at 100 ppm and the temperature was kept constant at 88° F.

Degrees of soil removal were evaluated as noted in the previous terg-o-tometer results. Results are summarized below. In tests of statistical significance, % SR (% Soil or % Stain Removal) results significantly higher than the control are denoted with (+), less than the control as (−), and equal as (=):

| | | Percent Stain/Soil Removal | | |
|---|---|---|---|---|
| | | Control (6.69 g surfactant) 96.9 g | 9-1 High Ash Formula (4.80 g surfactant) 2.37 oz dose 100.0 g | 9-1 High Ash Formula (3.16 g surfactant) 1.56 oz dose 65.9 g |
| STAINS | | | | |
| Grass | Cotton | 28.6 | 27.3= | 19.5− |
| Coffee | Cotton | 57.7 | 55.1= | 53.3− |
| Beef Gravy | Cotton | 78.2 | 78.0= | 77.8= |

-continued

| | | Percent Stain/Soil Removal | | |
|---|---|---|---|---|
| | | Control (6.69 g surfactant) 96.9 g | 9-1 High Ash Formula (4.80 g surfactant) 2.37 oz dose 100.0 g | 9-1 High Ash Formula (3.16 g surfactant) 1.56 oz dose 65.9 g |
| Ketchup | Cotton | 88.7 | 89.4= | 89.0= |
| Makeup | Cotton | 44.3 | 46.5= | 42.2= |
| EMPA 116 | Cotton | 20.8 | 23.2= | 23.0= |
| EMPA 112 | Cotton | 29.7 | 24.9− | 23.0− |
| Red Wine | Cotton | 69.3 | 61.0− | 60.8− |
| Choc Ice Cream | Cotton | 75.2 | 72.8= | 71.1− |
| Mustard | Cotton | 46.4 | 66.6+ | 61.7+ |
| Blueberry | Cotton | 79.2 | 77.2= | 77.5= |
| Blood | Cotton | 73.5 | 78.6+ | 75.4+ |
| EMPA 117 | PolyCotton | 18.5 | 21.0+ | 18.7= |
| TOTAL STAINS | | 710.1 | 721.4 | 692.9 |
| SOILS | | | | |
| Dust Sebum | Cotton | 47.7 | 56.6+ | 49.1= |
| Standard Soil | Cotton | 16.4 | 14.7= | 11.5− |
| EMPA 101 | Cotton | 27.6 | 30.5+ | 28.0= |
| Clay | Cotton | 52.1 | 48.8− | 47.7− |
| Dust Sebum | PolyCotton | 49.9 | 72.9+ | 56.4+ |
| EMPA 104 | Polycotton | 22.2 | 21.1= | 19.5= |
| Clay | Polycotton | 72.4 | 75.3= | 73.3= |
| TOTAL SOILS | | 288.0 | 319.8 | 285.5 |
| WHITNESS INDEX | | | | |
| delta b | | −1.2 | −0.4− | −0.4− |
| delta WIE | | 5.9 | 2.1− | 2.0− |
| pH 10 Min. into wash | | 9.4 | 10.3 | 10.1 |
| Total (stain + soil) | | 998.1 | 1041.2 | 978.4 |
| OVERALL STAIN REMOVAL | | 54.6 | 55.5= | 53.3= |
| OVERALL SOIL REMOVAL | | 41.1 | 45.7+ | 40.8= |
| Washer | | 6, 7 | 1, 4 | 3, 5 |

EMPA 116 = Blood, Milk and Carbon Black on Cotton, EMPA 101 = Carbon Black and Olive Oil on Cotton EMPA 117 = Blood, Milk and Carbon Black on Poly/Cotton, EMPA 104 = Carbon Black and Olive Oil on Poly/Cotton EMPA 112 = Cocoa on Cotton At the 2.37 oz. dose, overall stain removal was about the same as that of the control, while overall soil removal was higher. At the 1.56 oz. dose, performance was at about parity with the control. Among the different stain and soil types, some examples of higher and lower comparative performance levels were seen.

What is claimed:

1. An aqueous laundry detergent composition comprising:

a) greater than 15 wt. % of an alkali metal carbonate builder selected from the group consisting of sodium carbonate, potassium carbonate, or mixtures thereof;

b) at least one anionic surfactant;

c) at least one amphoteric surfactant;

d) an effective amount of a hygroscopic agent selected from the group consisting of urea, glycerine, or mixtures thereof, sufficient to reduce the formation of water insoluble hydrates of the carbonate builder; and e) about 45 to 75% water, wherein the weight ratio of anionic surfactant to amphoteric surfactant is from about 2:3 to about 3:1.

2. The aqueous laundry detergent of claim 1 containing 5-25% by weight of said hygroscopic agent.

3. The aqueous laundry detergent of claim 1 wherein said alkali metal carbonate builder comprises greater than 15 up to about 40 wt. % of said composition.

4. The aqueous laundry detergent of claim 3 wherein said alkali metal carbonate builder is present in amounts of from about 20 to about 30 wt. % of said composition.

5. The aqueous laundry detergent of claim 1 wherein the total amount of active surfactants comprise from about 3-10 wt. % of said composition.

6. The aqueous laundry detergent of claim 5 wherein said active surfactants comprise 3-6 wt. % of said composition.

7. The aqueous laundry detergent of claim 6 wherein the total amount of surfactant comprises from about 3 to less than 5 wt. % of said composition.

8. The aqueous laundry detergent of claim 1 further comprising at least one nonionic surfactant.

9. The aqueous laundry detergent of claim 1 wherein said anionic surfactant is selected from the group consisting of alkali metal salts of linear alkyl benzene sulfonates, the alkali metal salts of sulfated ethoxolated and un-ethoxolated fatty alcohols, and the alkali metal salts of sulfated ethoxolated alkyl phenols.

10. The aqueous laundry detergent of claim 1 wherein said hygroscopic agent is a mixture of glycerin and urea.

* * * * *